US010514231B1

(12) United States Patent
Hovey

(10) Patent No.: US 10,514,231 B1
(45) Date of Patent: Dec. 24, 2019

(54) SHOULDER SUPPORT FOR A FIREARM

(71) Applicant: David C. Hovey, Waddington, NY (US)

(72) Inventor: David C. Hovey, Waddington, NY (US)

( * ) Notice: Subject to any disclaimer, the term of this patent is extended or adjusted under 35 U.S.C. 154(b) by 0 days.

(21) Appl. No.: 16/536,252

(22) Filed: Aug. 8, 2019

Related U.S. Application Data

(60) Provisional application No. 62/722,963, filed on Aug. 26, 2018.

(51) Int. Cl.
*F41C 23/20* (2006.01)
*F41C 23/04* (2006.01)

(52) U.S. Cl.
CPC ..... *F41C 23/04* (2013.01); *F41C 23/20* (2013.01)

(58) Field of Classification Search
None
See application file for complete search history.

(56) References Cited

U.S. PATENT DOCUMENTS

| | | | | |
|---|---|---|---|---|
| 1,088,362 A | | 2/1914 | Perkins | |
| 2,441,487 A | | 5/1948 | Howard | |
| 2,787,855 A | | 4/1957 | Guymon | |
| 3,256,632 A | * | 6/1966 | Beretta | F41C 23/06 42/72 |
| 3,618,249 A | | 11/1971 | Grandy | |
| 6,250,009 B1 | | 6/2001 | Leontuk | |
| 7,337,573 B1 | | 3/2008 | DiGiovanna | |
| 7,930,849 B2 | | 4/2011 | Abraham et al. | |
| 8,464,458 B2 | | 6/2013 | Chhvala | |
| 8,763,296 B1 | * | 7/2014 | Chvala | F41C 23/14 42/73 |
| 2013/0036645 A1 | * | 2/2013 | Chvala | F41C 23/04 42/73 |

FOREIGN PATENT DOCUMENTS

| | | | | |
|---|---|---|---|---|
| DE | 3130562 A1 | | 2/1983 | |
| DE | 3130562 C2 | | 12/1984 | |
| WO | WO-2017147636 A1 | * | 9/2017 | F41C 23/12 |

OTHER PUBLICATIONS http://www.archerairguns.com/Adjustable-Buttplate-Kit-for-Benjamin-Marauder-p/marauderbuttplate.htm Archer Air Guns—Date Unknown—NPL1.

* cited by examiner

*Primary Examiner* — Stephen Johnson
(74) *Attorney, Agent, or Firm* — Michael E. Zall

(57) ABSTRACT

A shoulder support for mounting on an end of a rifle gunstock having a main body that rests against the shoulder in use. The shoulder support has an extension member pivotally connected to the bottom end of the main body that can be selectively pivoted from an extended position to a collapsed position. When in the extended position a surface of the extension member is substantially coplanar with the main body that rests against the shoulder during use to provide enhanced support for the rifle against the shoulder. There is a means for automatically locking the extension member into the extended position, means for rapidly unlocking the extension member to position it in the collapsed position and automatically holding the extension in the collapsed position.

11 Claims, 11 Drawing Sheets

42
44A
42C
46
42A
44
10
20
42B
44B
16B
48
24
16C
16
44C
16D
38A
18B
40C
34
36
18A
16A
18
40B
30
40A

SHOULDER SUPPORT FOR A FIREARM

RELATED APPLICATIONS

This application claims priority of provisional applications 62/722,963 filed on Aug. 26, 2018. The entire disclosure of this provisional application is incorporated herein by reference.

FIELD OF THE INVENTION

The present invention relates generally to firearms and, more particularly, pertains to a firearm stock assembly to facilitate firearm grip and handling. More specifically, this invention relates to an adjustable shoulder pad, shoulder support or butt-plate (hereinafter "shoulder support") for use on a shoulder fired weapon, for example a rifle, automatic firing rifle, and shotgun. The adjustable shoulder support can be mounted on the stock of such firearm as an aftermarket accessory or included in the original manufacture of the gunstock as an integral part of the originally manufactured gunstock.

BACKGROUND OF THE INVENTION

Typically a shoulder fired weapon has a stock made of wood, plastic, or metal extended rearward from the firing mechanism some finite distance creating the "gunstock", "gun butt" or "butt stock" portion. This gunstock portion is used to stabilize the weapon when being used. The user presses the rear end of the gunstock into his or her shoulder while taking aim and firing the weapon. Typically, the shoulder support is intended to rest against the shoulder of the user and is provided with a concavity to help the user keep the butt stock against the shoulder.

A major problem with many rifles, and in particular the currently used military rifles, is that the shoulder contact area, is too short in height. This short shoulder stock results in a small contact area of the shoulder support or butt with the shoulder. Such small contact area can cause bruising due to the concentration of the force from the kickback from the rifle when fired. Additionally, a shooter may tend to contort into an uncomfortable position or is forced to place the shoulder stock on top of the shoulder, thus losing the needed control to line-up the rifle sights with the target. Still further, in firing the firearm it is important that the shooter maintain the firearm absolutely steady while maintaining the site picture through the scope and or sites. However because of the weight of the firearm, the time necessary to develop the site picture, tension, fear, etc., is oftentimes difficult to hold the firearm steady the length of time necessary to squeeze the trigger and fire.

Attempts have been made to advance the functionality of the stock assembly to include various folding and/or sliding configurations, but these have generally been found not to be reliable and/or durable over repeated operation, Previous gun stock assemblies have been unsatisfactory due to, among other things, numerous pieces or parts, unreliable and slow transitions and occasional jamming between configurations, and creating interference in operating the firearm.

In view of these challenges, it is desirable to provide a shoulder stock or shoulder support which overcomes these and other drawbacks.

The following references may be relevant to this invention:

U.S. Pat. No. 8,464,458 B2 to Chvala discloses a pivotable and length adjustable firearm stock assembly that includes a pivot stock having one end provided with a combined pivoting and latching arrangement movable about a horizontal pivot axis and adapted to be pivotally mounted on a rear end of the firearm.

U.S. Pat. No. 7,930,849 B2 to Abraham discloses an adjustable butt stock.

U.S. Pat. No. 7,337,573 B1 to DiGiovanna discloses a butt for a rifle having a pivoting lower section that locks into place.

U.S. Pat. No. 6,250,009 B1 to Leontuk discloses a brace for use by a shooter to brace a long gun.

U.S. Pat. No. 3,618,249 A to Grandy.

U.S. Pat. No. 2,441,487 A to Howard.

U.S. Pat. No. 2,787,855 A to Guymon discloses an adjustable rifle butt that slides downward.

U.S. Pat. No. 1,088,362 A to Perkins discloses an adjustable rifle butt plate.

DE 3130562 A1 to Weisser discloses a telescopic butt.

The following non-patent reference shows an adjustable buttplate. http://www.archerairguns.com/Adjustable-Buttplate-Kit-for-Benjamin-Marauder-p/marauderbuttplate.htm

OBJECTS AND SUMMARY OF INVENTION

This invention is directed to a shoulder support for mounting on an end of a rifle gunstock that includes a main body that rests against the shoulder. An extension member is provided that is pivotally connected to the bottom end of the main body. The extension member is adapted to selectively pivot from an extended position to a collapsed position. When in the extended position a surface of the extension member is substantially coplanar with the main body that rests against the shoulder during use to provide enhanced support for the rifle against the shoulder.

The device provides for the extension member to automatically lock into the extended position, rapidly unlock to position the extension member in the collapsed position and automatically held in this position.

This invention lengthens the shoulder contact area of the butt extending it downward. The extension allows the shoulder and the shoulder support to have full contact with each other, while allowing the head and neck to remain comfortably upright during the sighting of the rifle.

More specifically, this invention is directed to an adjustable shoulder support, e.g., butt pad, for mounting on an end of a gunstock of a firearm. The adjustable shoulder support includes an elongated main body that has a chamber therein and has an inner wall adapted to be mounted to the end of the gunstock and an opposed outer wall adapted to be placed on a user's shoulder.

An elongated extension member is provided that has a first surface, an opposed second surface, a pivot end and an opposed free end. The pivot end of the extension member is pivotally connected to the bottom end of the main body. The extension member has a lock member located at the pivot end. The extension member can be selectively pivoted by the user from an extended position to a collapsed position. When the extension member is in extended position the first surface of the extension member is substantially coplanar with the opposed outer wall of the main body and the lock member protrudes into the chamber at the bottom end of the main body. When the extension member is in the collapsed position the first surface of the extension member is not substantially coplanar with the opposed outer wall of the main body.

A lock release cap is provided that is slidably mounted to the upper end of the elongated main body. The lock release cap is adapted to be grasped by the user to unlock the extension member from the extended position. The lock release cap has a lower end and an upper end and a through hole connecting the upper end and lower end of the lock release cap.

A connecting rod is provided that has an upper end, a mid-section and a lower locking end. The upper end of the connecting rod is slidably mounted within the through hole of the lock release cap. The upper end of the connecting rod has a stop means on the upper end of the connecting rod to enable the connecting rod to travel with the release cap when the release cap is raised to unlock the extension member from the extended position.

The mid-section of the connecting rod is slidable within the chamber of the main body and surrounded by a spring means, e.g., helical spring, that urges the lower locking end of the connecting rod toward the bottom end of the main body. The lower locking end of the connecting rod slideably mates with the locking member of the extension member when the extension member is selectively positioned in the extended position to automatically lock the extension member in the extended position.

When the extension member is selectively pivoted to the extended position by the user, the lock member of the extension member contacts the lower locking end of the connecting rod to raise the upper end of the connecting rod above the upper end of the lock release cap and when in the extended position the spring means urges the lower locking end of the connecting rod toward the bottom end of the main body forcing the lower locking end of the connecting rod to slidingly mate with the lock member of the extending member to lock the extending member in the extended position.

When it is decided by the user that he/she wants to move the extension member to the collapsed position, the lock release cap is grasped by the user to raise the release cap. The stop means on the upper end of the connecting rod travels with and is raised with the lock release cap causing the lower locking end of the connecting rod to slidingly disengage from the locking member of the extending member to permit the extending member to pivot to the collapsed position. The extension member is then folded up out of the way when not in use and can easily and rapidly pivoted to and locked in the extended position.

The shoulder support of this invention can be an "add on" or accessory to an existing firearm or included as a built-in or integral feature of a firearm. The "add on" model can be adopted for use on many rifle stocks by providing universal or specific adaptors for mounting.

The shoulder support of this invention may be made of many materials, e.g., metal, steel, aluminum and plastic. A high strength molded polymer (plastic) is a preferred material of manufacture.

BRIEF DESCRIPTION OF THE DRAWINGS

The foregoing, as well as other objects of the present invention will be further apparent from the following detailed description of the preferred embodiment of the invention, when taken together with the accompanying specification and drawings, in which.

Figure 1:
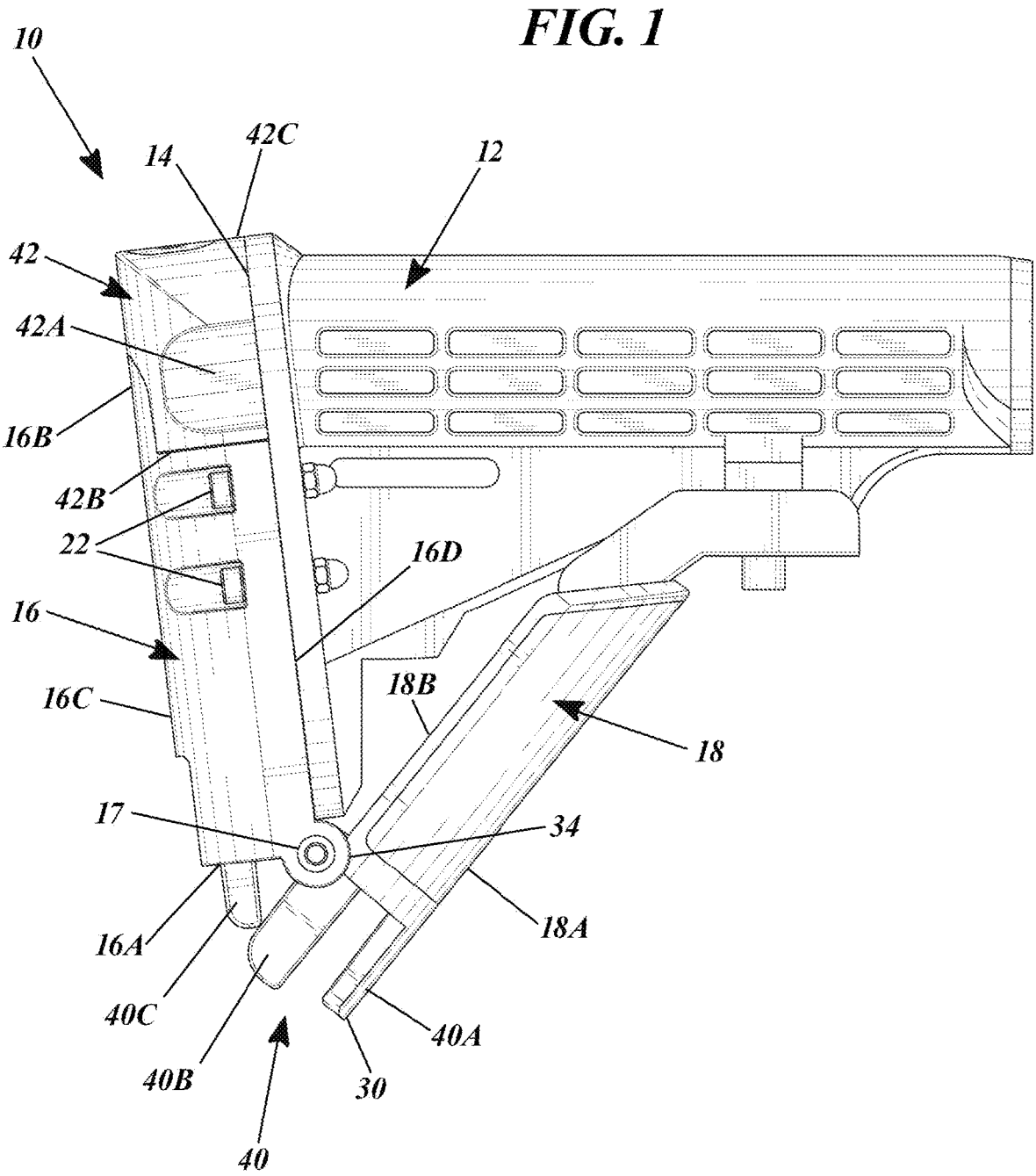
FIG. 1 is a side view of a preferred embodiment of the auto-locking shoulder support of this invention for mounting on an end of a gunstock of a firearm in a collapsed, closed or folded position.

The drawings are not presented to scale but are only used to illustrate the principles of the invention.

DETAILED DESCRIPTION OF THE INVENTION

The accompanying drawings and the description which follows set forth this invention in its preferred embodiment. However, it is contemplated that persons generally familiar with the art will be able to apply the normal characteristics of the structures illustrated and described herein in other contexts by modification of certain details. Accordingly the drawings and description are not to be taken as restrictive on the scope of this invention but are to be understood as broad and general teachings.

Referring now to the drawings in detail, wherein like reference characters represent like elements or features throughout the various views, the shoulder support of the present invention, is indicated generally in the figures by reference character 10.

Figure 6:
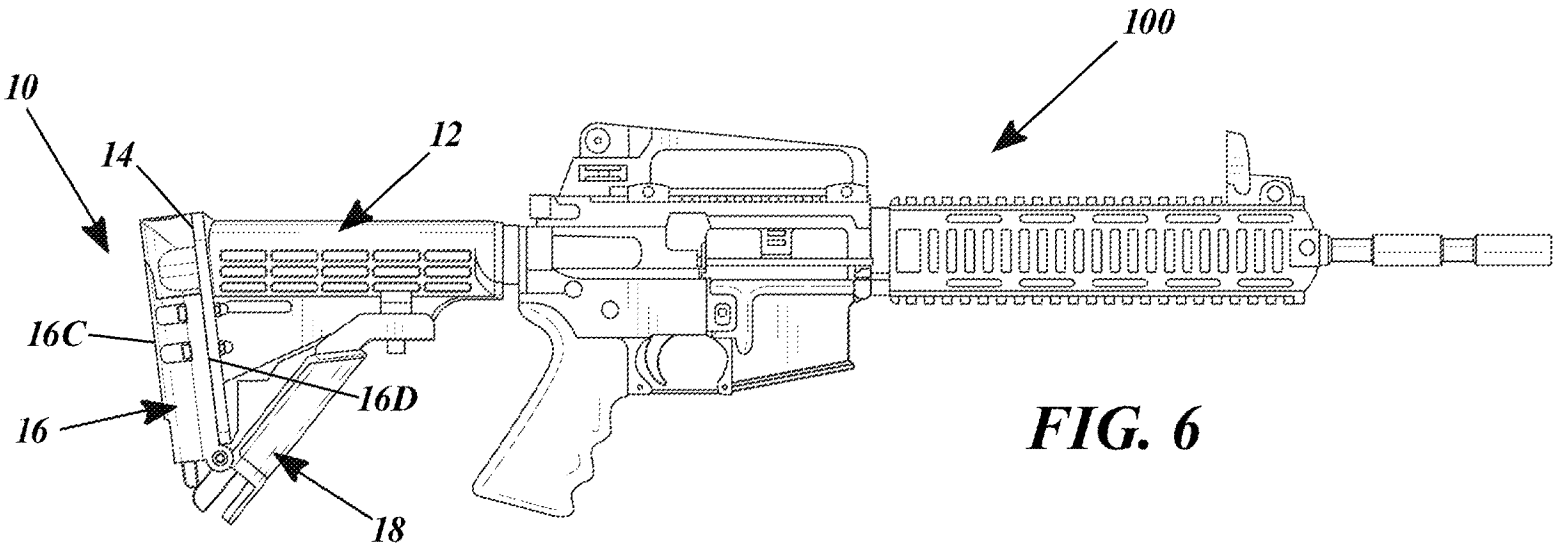
FIG. 6 is a side view of the auto-locking foldable shoulder support of this invention in the collapsed position, i.e., folded up to the non-extended or closed position, mounted to the end of a gunstock of a firearm, i.e., rifle.
Figure 7:
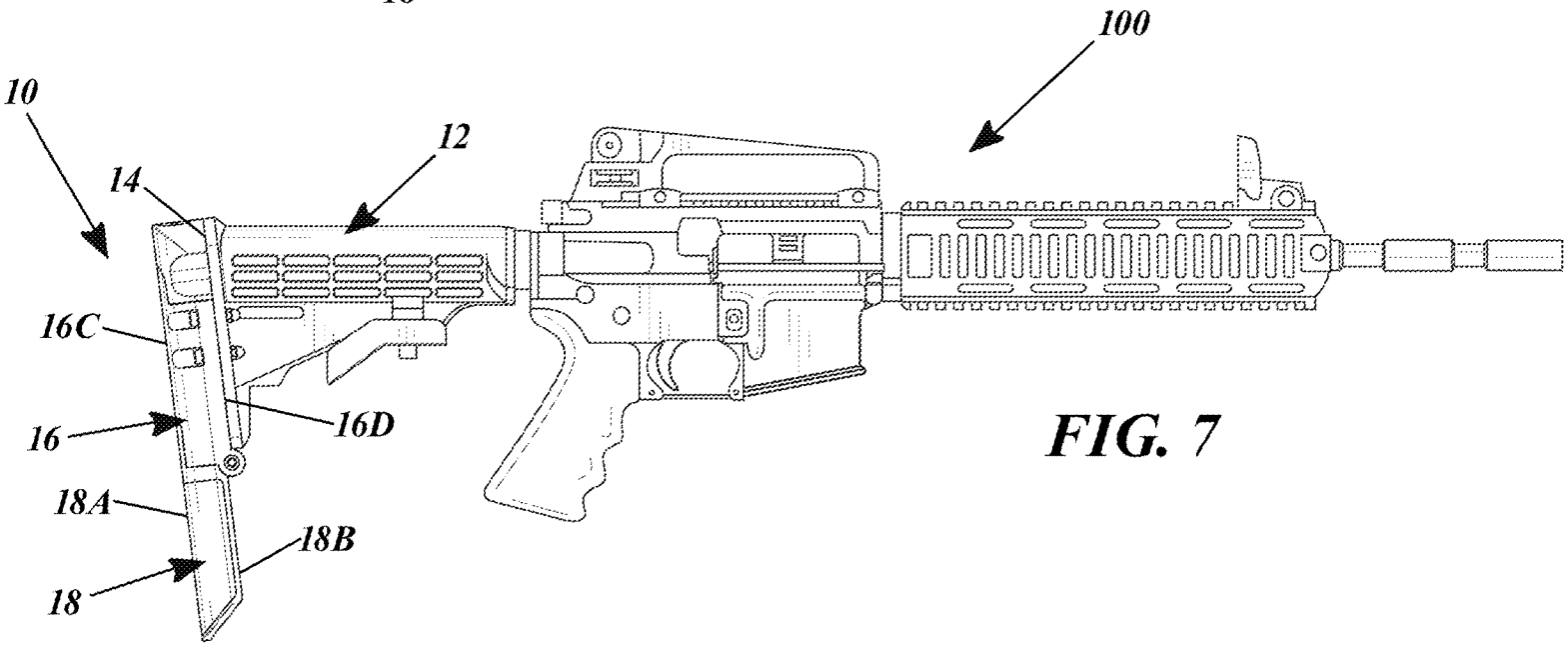
FIG. 7 is a side view of the auto-locking foldable shoulder stock of this invention unfolded to the locked extended or open position, mounted to the end of a gunstock of a firearm, i.e., rifle.

Referring to FIGS. 6 and 7, broadly, this invention is directed to a shoulder support 10 for mounting on an end 14 of a gunstock 12 of a firearm, particularly a rifle 100. Although the firearm 100 depicted in FIGS. 6 and 7 of the drawings depict an automatic rifle, the shoulder support 10 of this invention may be used on any type rifle, e.g., hunting rifle, shotgun, etc. where the user places the end 14 of the gunstock 12 or butt of the firearm against his/her shoulder to use.

Referring to FIG. 1, the shoulder support 10 includes a main body 16 that rests against the shoulder of the user (not shown). An extension member 18 is provided that is pivotally connected to the bottom end 16A of the main body 16 at a pivot point 17. The extension member 18 is adapted to selectively pivot by the user from an extended position, see FIGS. 3, 7 to a collapsed position, see FIGS. 1, 6, 7.

Figure 3:
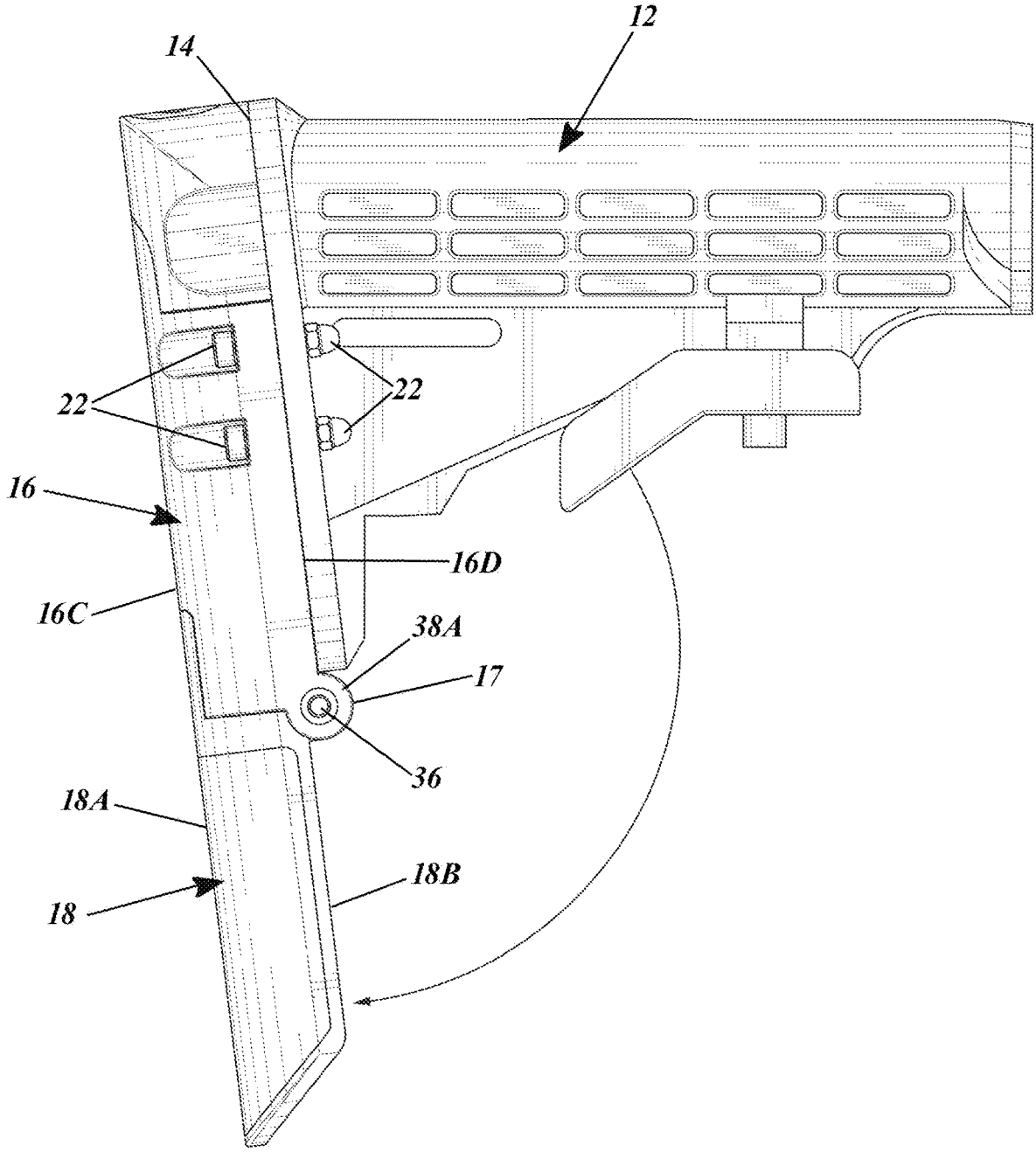
FIG. 3 is a side view of the auto-locking foldable shoulder stock of this invention unfolded to the locked extended or open position.

Referring to FIG. 3, when in the extended position a first surface 18A of the extension member 18 is substantially coplanar with the outer wall 16C main body 16 that rests against the shoulder during use to provide enhanced support for the rifle 100 against the shoulder. There is a means for automatically locking the extension member 18 into the extended position (FIGS. 3, 7), a means for rapidly unlocking the extension member 18 to position it in the collapsed position (FIGS. 1, 6) and preferably automatically holding the extension member 18 in the collapsed position.

Referring to FIGS. 3, 7, this invention lengthens the shoulder contact area of the butt extending it downward. The extension member 18 when extended allows the shoulder and the shoulder support of this invention to have full contact with each other, while allowing the head and neck to remain comfortably upright during the sighting of the rifle.

Figure 1A:
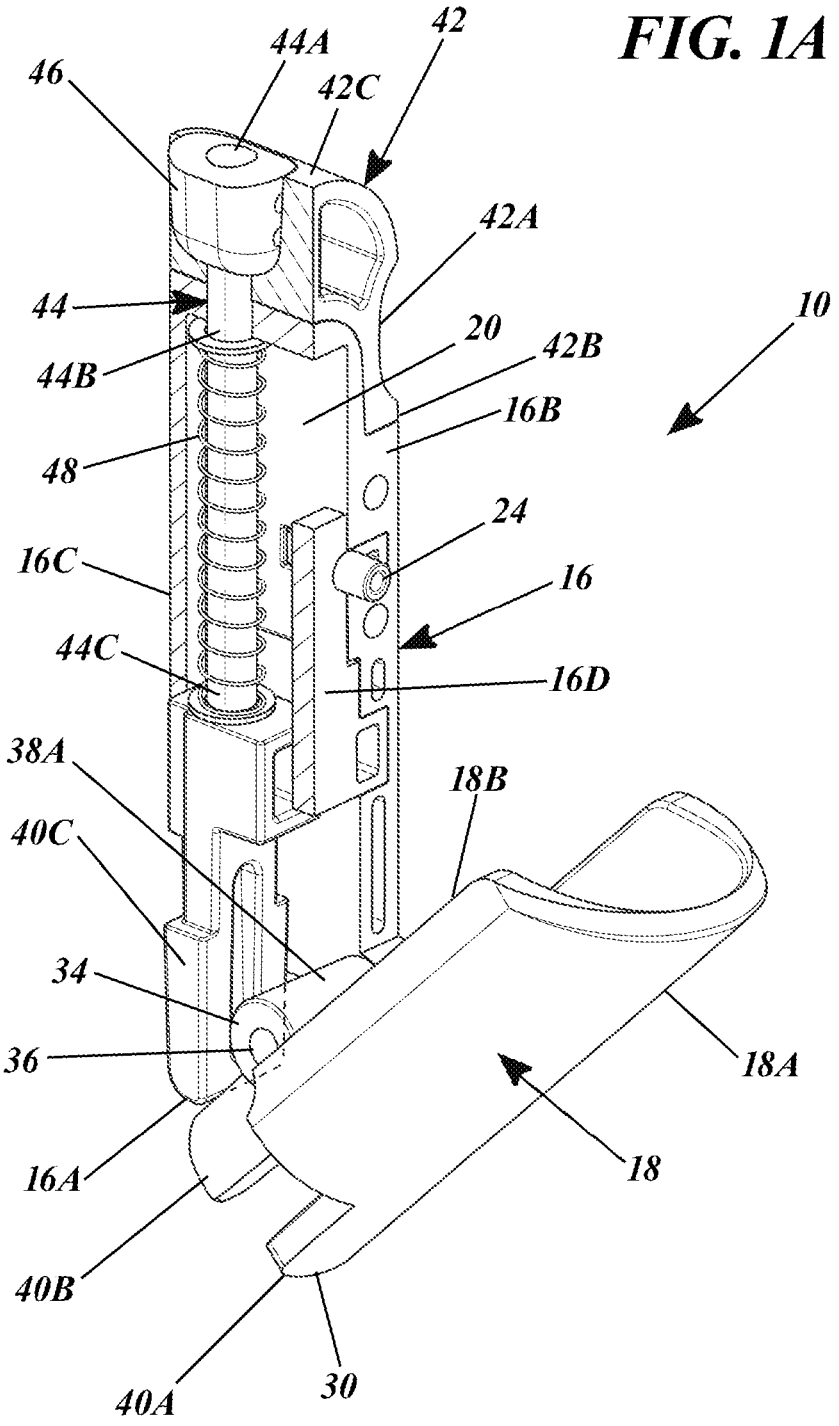
FIG. 1A is a side sectional perspective view of the auto-locking auto-locking shoulder support of this invention in a collapsed, closed or folded position.

Referring to FIGS. 1, 1A for example, the adjustable shoulder support 10 includes an elongated main body 16 that has a chamber 20 therein. The main body 16 has an inner wall 16D adapted to be mounted to the end of the gunstock 14 and an opposed outer wall 16C adapted to be placed on a user's shoulder. Optionally, the opposed outer wall 16C may be structured or curved to conform to the shape of the shoulder of the user and/or the opposed outer wall 16C may have a cushioning pad thereon to absorb the shock of recoil of the firearm 100.

Preferably, the main body 16 is adapted to be removably mounted to the end of the gunstock 14. As shown in the FIGS. 1, 1A, 6, 7 for example, removable mounting screws 22 pass through holes 24 in the main body 16 to secure the inner wall 16C of shoulder support 10 to the end of the gunstock 14.

Alternatively the shoulder support 10 may have a removable mounting means. e.g., a clamp (not shown), to attach the shoulder support 10 to the end 14 of the gunstock. This has the advantage over the aforedescribed screw mounts in that it does not require drilling holes through rifle stock.

Another alternative includes mating channels and tongs on the inner wall 16D of the main body 16 of the shoulder support 10 and the end of the gunstock 14 (not shown) that permits the shoulder support 10 to be easily slid off and slid on to the end 14 of the gunstock 12.

Figure 2:
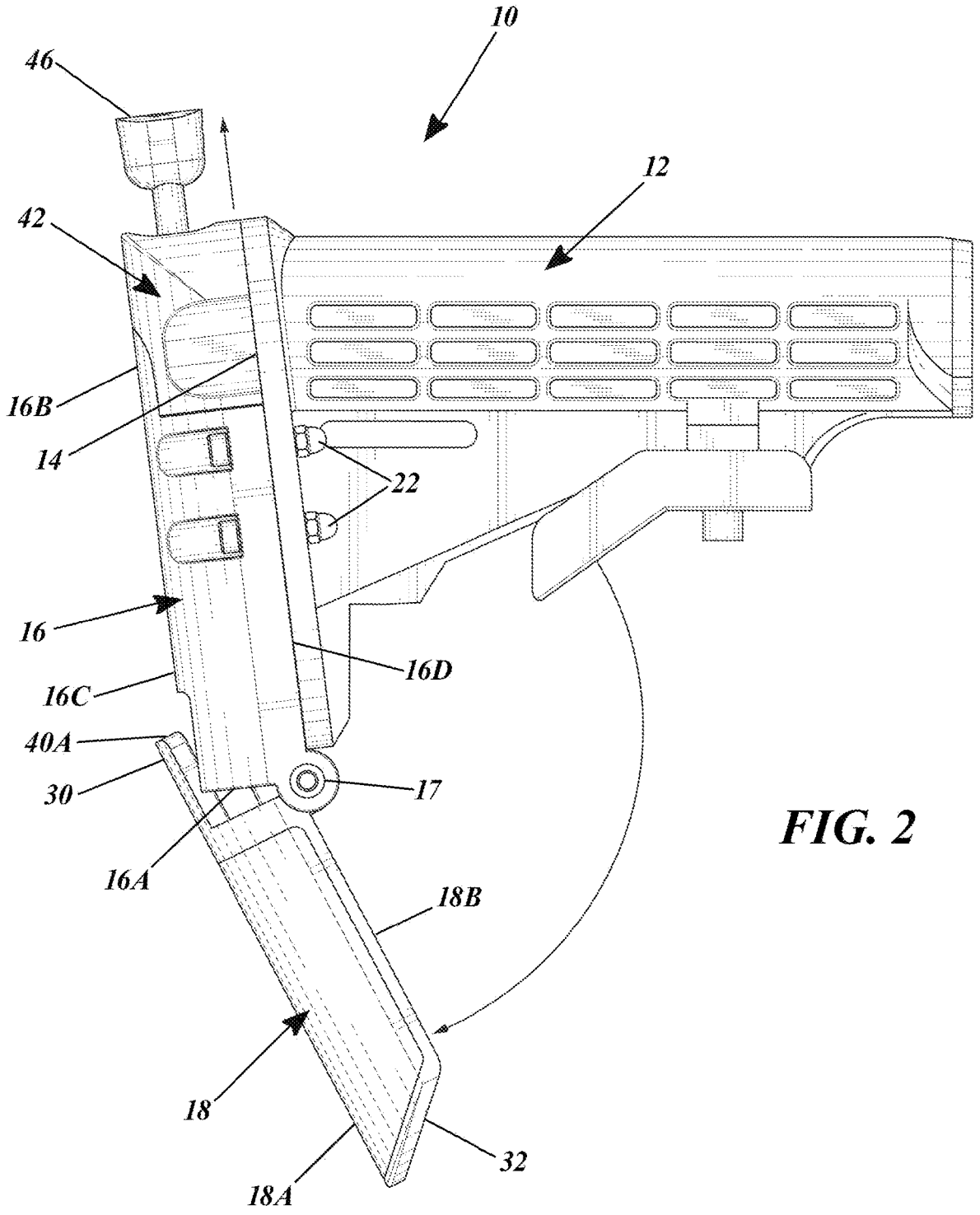
FIG. 2 is a side view of the of the auto-locking shoulder support of this invention being unfolded to an extended or open position.

Referring to FIGS. 1, 2, 3, an elongated extension member 18 is provided. The extension member 18 has a first surface 18A and an opposed second surface 18B, a pivot end 30 and an opposed free end 32. The pivot end 30 of the extension member 18 is pivotally connected through a pivotal connection 34 to the bottom end 16A of the main body 16.

Referring to FIGS. 1, 3, the first surface 18A of the extension member 18 when fully extended, is adapted to be placed on the user's shoulder when the firearm 100 is used. The first surface 18A may be structured or curved to conform to the shape of the shoulder of the user and/or the first surface 18A may have a cushioning pad thereon to absorb the shock of recoil of the firearm 100.

Referring for example to FIGS. 1, 2A, 4A, 3A, the pivotal connection 34 includes a hinge pin 36 that passes through a hinge channel 38A mounted to the pivot end 30 of the extension member 18 and through two outer hinge channels 38B mounted at the bottom end 16A of the main body 16 to pivotally connect the bottom end 16A of the main body 16 at a pivot point 17.

Referring to FIGS. 1, 2A, 3A, 4A, 5A the extension member 18 has a lock member 40 located at the pivot end 30 of the extension member 18. The lock member 40 depicted consists of two parallel tongs 40A, 40B that slidably lock with the lower locking end, i.e., tongue 40C of the connecting rod 44.

Figure 3A:
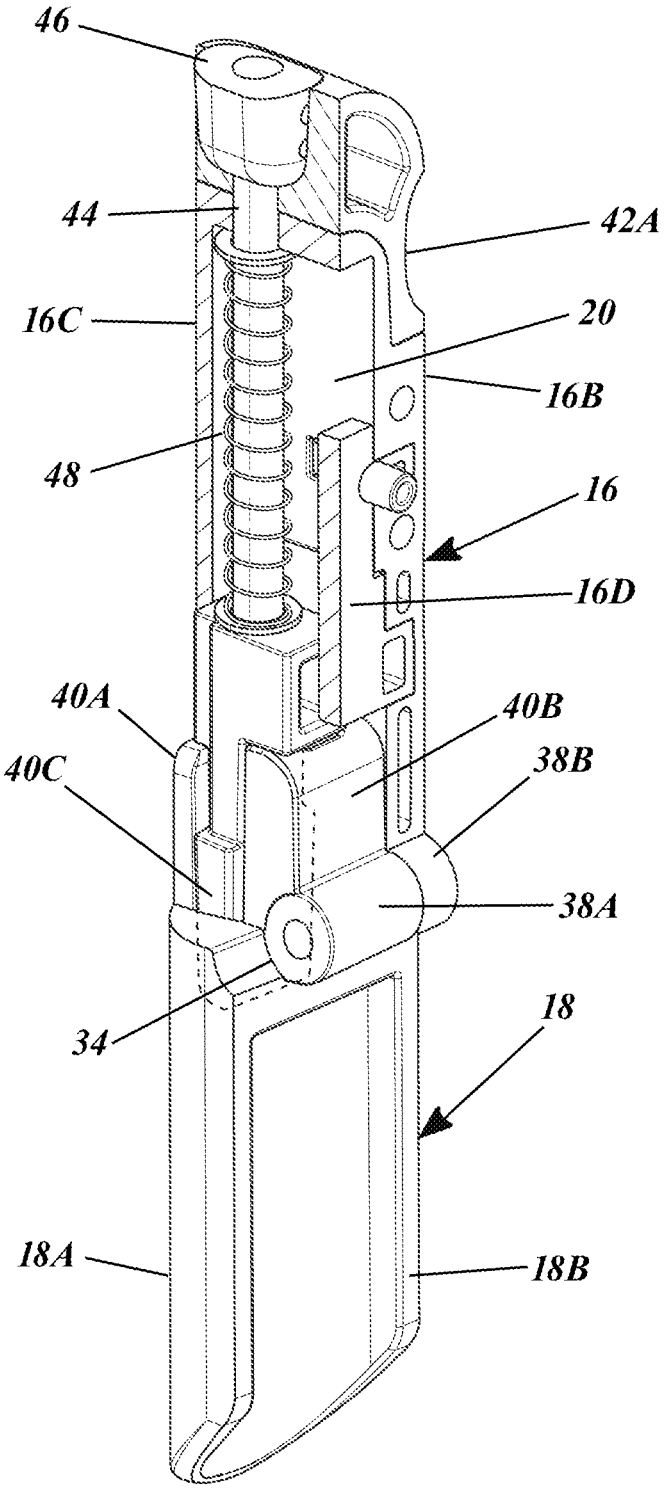
FIG. 3A is a side sectional perspective view of the auto-locking foldable shoulder support of this invention unfolded to the locked extended or open position.
Figure 5:
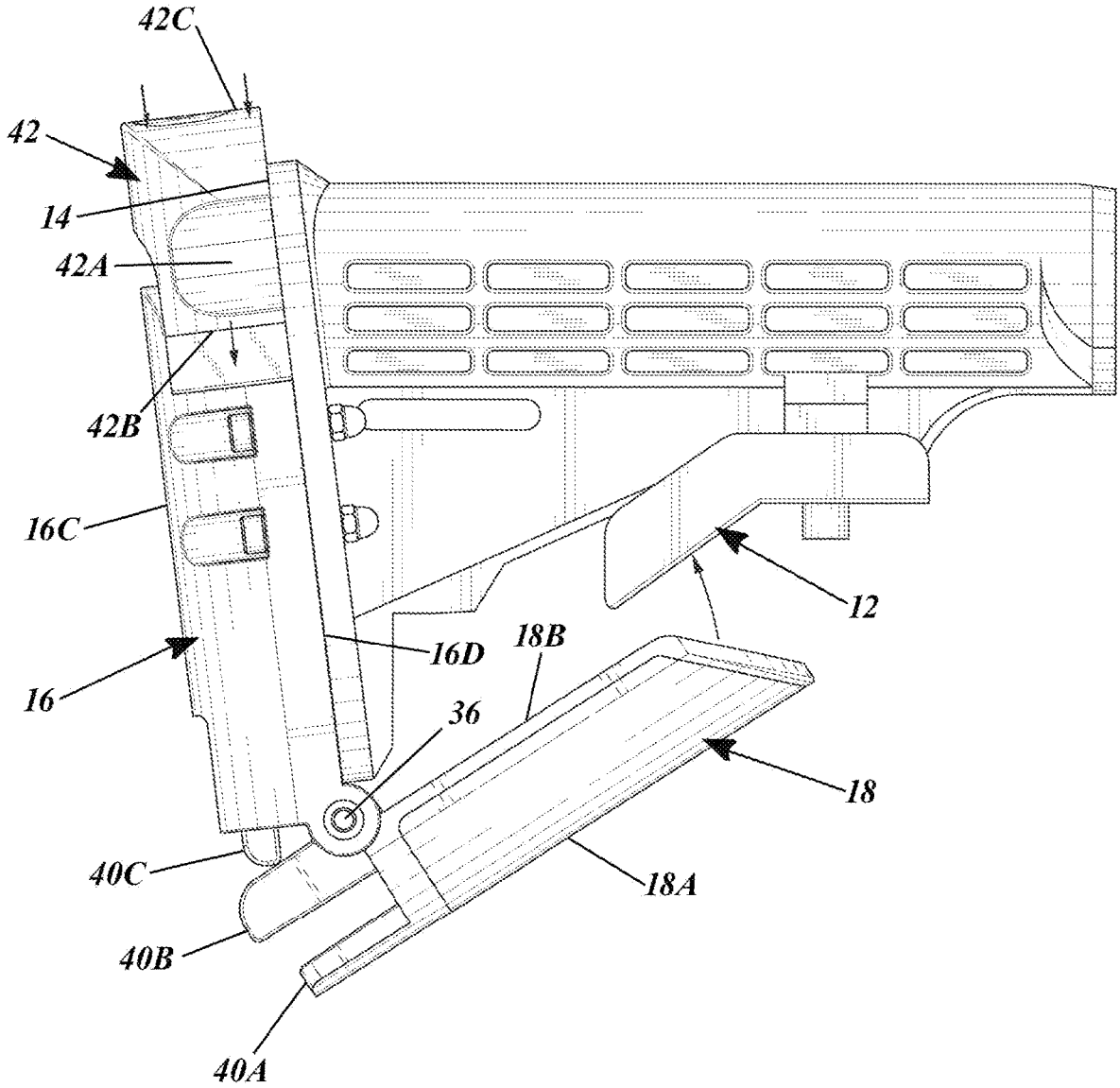
FIG. 5 is a side view of the auto-locking foldable shoulder support of this invention in the collapsed position, i.e., folded up to the non-extended or closed position.
Figure 5A:
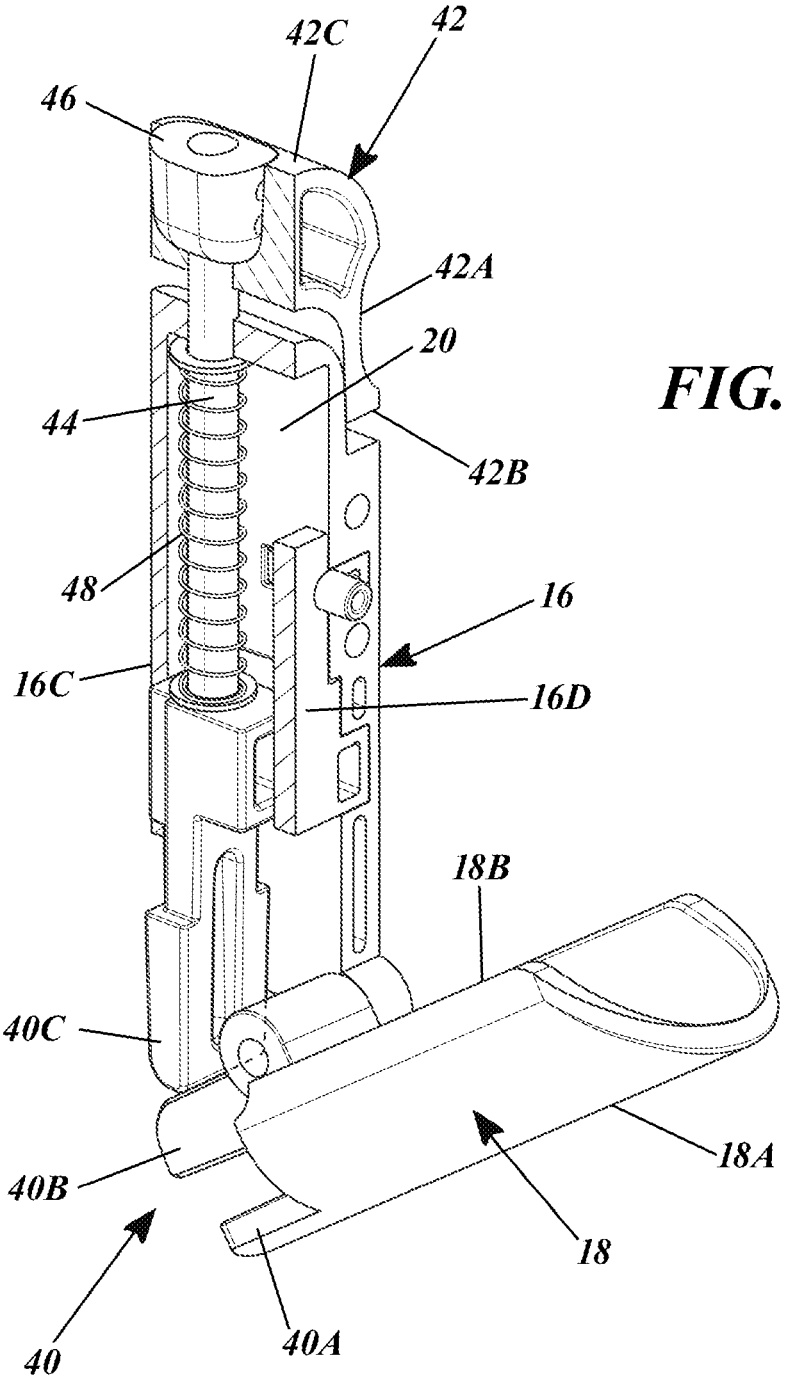
FIG. 5A is a side sectional perspective view of the auto-locking foldable shoulder support of this invention in the collapsed position. i.e., folded up to the non-extended or closed position.

The extension member 18 can be selectively pivoted from an extended position, as shown in FIGS. 3, 3A, 7, to a collapsed position, as shown in FIGS. 1, 1A, 6. When the extension member 18 is in the extended position, see FIG. 3, the first surface 18A of the extension member 18 is substantially coplanar with the opposed outer wall 16C of the main body 16. Referring to FIG. 5, when the extension member is in the collapsed position the first surface 18A of the extension member 18 is not substantially coplanar with the opposed outer wall 16C of the main body 16.

Referring to FIG. 3A, when the extension member 18 is in the extended position, the lock member 40 and the tongs 40A, 40B protrudes into the chamber 20 at the bottom end 16A of the main body 16.

Figure 4:
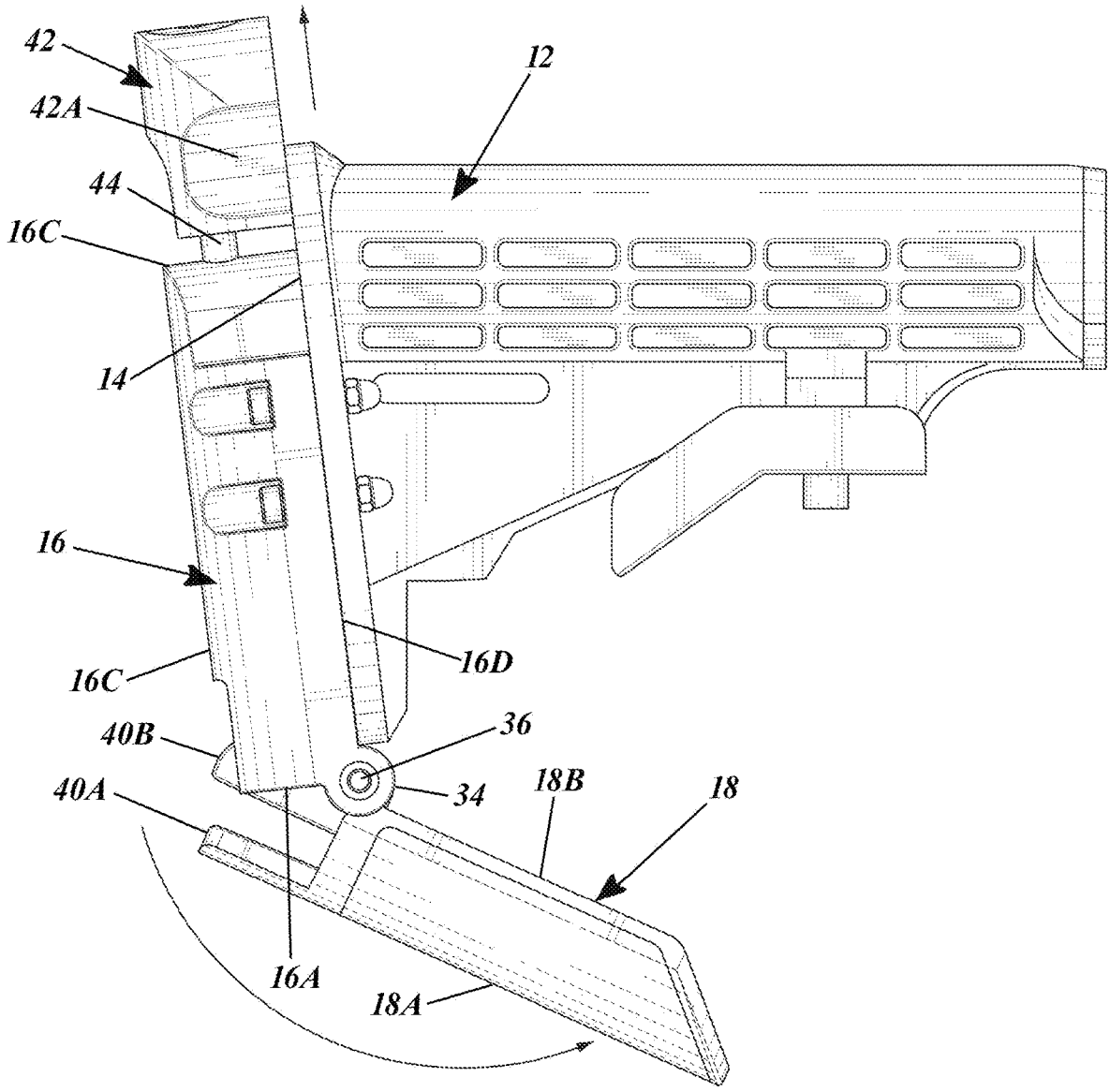
FIG. 4 is a side view of the auto-locking foldable shoulder support of this invention being unlocked from the extended position and folded up to the collapsed, non-extended or closed position.
Figure 4A:
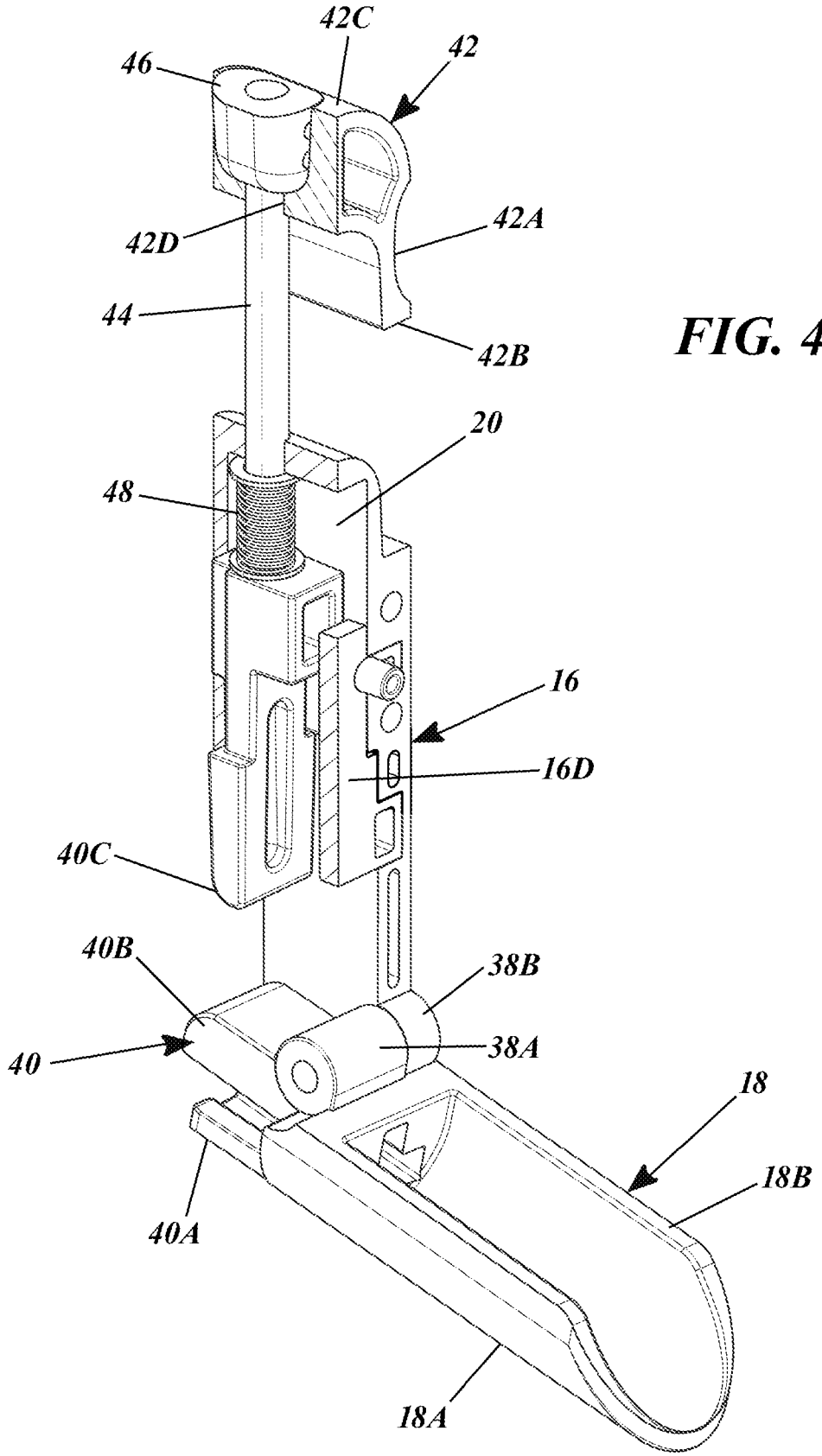
FIG. 4A is a side sectional perspective view of the auto-locking foldable shoulder support of this invention being unlocked from the extended position and folded up to the collapsed, non-extended or closed position.

Referring for example to FIGS. 4, 4A, a lock release cap 42 is provided that is slidably mounted to the upper end 16B of the elongated main body 16. The lock release cap 42 is adapted to be grasped by the user to unlock the extension member 18 from the extended position. The lock release cap 42 has indentations 42A on both sides of the release cap for the user's fingers to enable and/or enhance the grasp of the lock release cap 42 by the user to raise it (see FIGS. 4, 4A) to unlock the extension member 18 from the extended position. The lock release cap 42 has a lower end 42B and an upper end 42C and a through hole 42D connecting the upper end 42C and lower end 42B of the lock release cap 42.

Figure 2A:
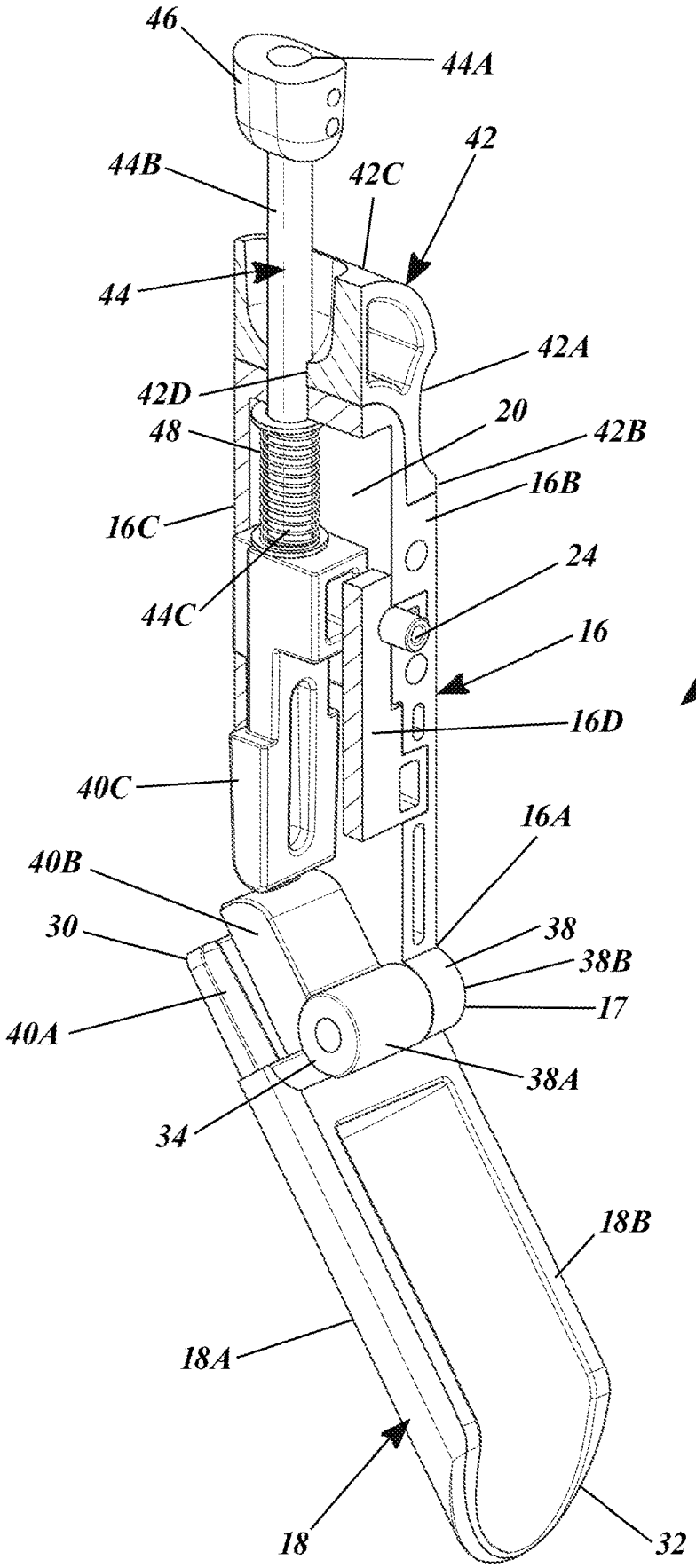
FIG. 2A is a side sectional perspective view of the of the auto-locking shoulder support of this invention being unfolded to an extended or open position.

Referring to FIGS. 1A, 2A, 3A, 4A, SA, a connecting rod 44 is provided that has an upper end 44A, a mid-section 44B and a lower locking end 44C. The upper end 44A of the connecting rod 44 is slidably mounted within the through hole 42D of the lock release cap 42. Referring to FIG. 2A, the upper end 44A of the connecting rod 44 has a stop means 46 on the upper end 44A of the connecting rod 44 to enable the connecting rod 44 to travel with the lock release cap 42 when the release cap 42 is raised to unlock the extension member 18 from the extended position.

Referring again to FIGS. 1A, 2A, 3A, 4A, 5A, the mid-section 44B of the connecting rod 44 is slidable within the chamber 20 of the main body 16 and surrounded by a spring means 48, preferably a helical spring, that urges the lower locking end 44C of the connecting rod 44 toward the bottom end 16A of the main body 16.

Referring for example to FIGS. 1A, 2A when the extension member 18 is pivoted to the extended position, the tongs 40A, 40B engage the tongue 40C the on lower locking end 44C of connecting rod 44. The tongs 40A, 40B force the connecting rod 44 upward compressing the helical spring 48 against shoulder 52 that is located near the upper end of the chamber 20, When the tongue 40C is raised high enough by the tongs 40A, 40B, the tongue 40C is forced downward by the compressed spring 48 forcing the tongue 40C on the lower locking end 44C of the connecting rod 44 to slideably mate between the tongs 40A, 40B on locking member 40 of the extension member 18. This causes the extension member 18 to be automatically locked in the extended position.

Thus, when the extension member 18 is selectively pivoted to the extended position, the lock member 40 contacts the lower locking end 44C of the connecting rod 44 to raise the upper end 44A of the connecting rod 44 above the upper end 42C of the lock release cap 42, see FIGS. 2, 2A, and when in the final extended position (FIGS. 3, 7) the spring means 48 urges the lower locking end 44C of the connecting rod 44 toward the bottom end 16A of the main body 16 forcing the lower locking end 44C of the connecting rod 44 to slidingly mate or engage with the lock member 40 of the extending member 18 to lock the extending member 18 in the extended position.

More specifically, FIGS. 2A, 3A, 4A, 5A, depict side sectional perspective views of the auto-locking foldable shoulder support 10 of this invention in various modes between the collapsed and extended positions. The Figures reveal that when the extension member 18 is pivoted or rotated downward by hand to the extended position the single tongue-like member 40C of the lower locking end 44C of the connecting rod 44 is raised and then the spring 48 urges the single tongue-like member 40C into the fork-like member or tongs 40A and 40B to auto-lock the extension member 18 in the extended position ready for use. Unlocking the extension member 18 for folding is accomplished with a simple pull of the lock release cap 42 that pulls the connecting rod 44 up against the spring 48 to remove the tongue 40C from tongs 40 and 40B. The extension member 18 is then folded up out of the way when not in use and can easily and rapidly pivot to and locked in the extended position.

Referring to FIGS. 1 and 6, in a preferred embodiment, the extension member 18 rests on a flat spot of the gunstock 12 and is maintained in that position by the interaction of the tongue 40C being urged by spring 48 on the connecting rod 44 against tong 40A.

The shoulder support of this invention can be an "add on" or accessory to an existing firearm or included as a built-in or integral feature of a firearm. The "add on" model can be adopted for use on many rifle stocks by providing universal or specific adaptors for mounting.

The shoulder support of this invention may be made of many materials, e.g., metal, steel, aluminum and plastic. A high strength molded polymer (plastic) is a preferred material of manufacture.

An option, as shown in the Figures, is to have the mounting screws 22 projecting into the main body 16 the rifle side. In this design adaptor plates mounted on the on butt stocks. The adaptor plate must be attached to the butt stock first, then the shoulder support unit 10 is mounted to the adaptor plate.

The invention has been described with reference to various specific and illustrative aspects of the present invention and techniques. However, it should be understood that many variations and modifications may be made while remaining within the spirit and scope of the invention. Many alternatives, modifications and variations will be apparent to those skilled in the art in light of the foregoing description. Accordingly, this invention is intended to embrace all such alternatives, modifications, and variations that fall within the spirit and scope of the description.

ELEMENTS

| ELEMENT NO. | Description |
|---|---|
| 100 | Firearm, generally |
| 10 | Shoulder support, generally |

-continued

ELEMENTS

| ELEMENT NO. | Description |
|---|---|
| 12 | Gunstock of firearm |
| 14 | End of Gunstock |
| 16 | Main Body |
| 16A | Bottom end of Main Body 16 |
| 16B | Top or upper end of Main Body 16 |
| 16C | Outer wall |
| 16D | Inner wall |
| 17 | Pivot point |
| 18 | Extension member |
| 18A | First surface |
| 18B | Second Surface |
| 20 | Chamber in Main Body |
| 22 | Mounting screws (4) |
| 24 | Through holes for mounting screws |
| 30 | Pivot end of extension member |
| 32 | Free end of extension member |
| 34 | Pivotal connection |
| 36 | Hinge pin |
| 38A | Hinge channel mounted to extension |
| 38B | Outer hinge channels (2) |
| 40 | lock member located at the pivot end of extension member |
| 40A | Tong of lock member 40 |
| 40B | Tong of lock member 40 |
| 40C | Tongue on lower locking end of connecting rod |
| 42 | Lock release cap |
| 42A | Indentations on lock release cap (both sides) |
| 42B | Lower end of lock release cap |
| 42C | Upper end of lock release cap |
| 42D | Through hole through lock release cap |
| 44 | Connecting Rod |
| 44A | Upper end of connecting rod |
| 44B | Mid-section of connecting rod |
| 44C | Lower locking end of connecting rod |
| 46 | Stop means on top of connecting rod |
| 48 | Helical spring |

The invention claimed is:

1. A shoulder support for mounting on an end of a gunstock of a firearm to be held on a user's shoulder, the adjustable shoulder support comprising:

a. an elongated main body that includes a chamber having an inner wall and an opposed outer wall, a top end and a bottom end, wherein the inner wall of the main body is adapted to be mounted to the end of the gunstock and the opposed outer wall of the main body is adapted to be placed on a user's shoulder;

b. an elongated extension member having a first surface and an opposed second surface, and a pivot end and an opposed free end, wherein the extension member is pivotally connected to the bottom end of the main body at the pivot end of the extension, the extension having a lock member located at the pivot end, wherein the extension member can be selectively pivoted from an extended position to a collapsed position, such that i. when in the extended position the first surface of the extension member is substantially coplanar with the opposed outer wall of the main body and the lock member protrudes into the chamber at the bottom end of the main body; and ii. when in the collapsed position the first surface of the extension member is not substantially coplanar with the opposed outer wall of the main body;

c. a lock release cap slidably mounted to the upper end of the elongated main body adapted to be grasped by the user, the lock release cap having a lower end and an upper end and a through hole connecting the upper end and lower end of the lock release cap;

d. a connecting rod having an upper end, a mid-section and a lower locking end, i. the upper end of the connecting rod slidably mounted within the through hole of the lock release cap and having a stop on the upper end of the connecting rod to enable the connecting rod to travel with the release cap when the release cap is raised by the user;

ii. the mid-section of the connecting rod slidable within the chamber of the main body and surrounded by a spring that urges the lower locking end of the connecting rod toward the bottom end of the main body;

iii. the lower locking end of the connecting rod slideably mates with the lock member of the extension member when the extension member is selectively positioned in the extended position to lock the extension member in the extended position;

wherein when the extension member is selectively pivoted to the extended position, the lock member contacts the lower locking end of the connecting rod to raise the upper end of the connecting rod above the upper end of the lock release cap and when in the extended position the spring urges the lower locking end of the connecting rod toward the bottom end of the main body forcing the lower locking end of the connecting rod to slidingly mate with the lock member of the extending member to lock the extending member in the extended position, and subsequently when the lock release cap is grasped by the user to raise the release cap the stop on the upper end of the connecting rod is raised with the lock release cap causing the lower locking end of the connecting rod to slidingly disengage from the lock member of the extending member to permit the extending member to pivot to the collapsed position.

2. The shoulder support of claim 1, wherein when the extending member is in the collapsed position the spring urges lower locking end of the connecting rod to abut the lock member of the extending member to maintain the extending member in the collapsed position.

3. The shoulder support of claim 2, wherein with the free end abuts against the gunstock.

4. The shoulder support of claim 1, wherein the main body is integrally included in the end of the gunstock.

5. The shoulder support of claim 1, wherein the main body is adapted to be removably mounted to the end of the gunstock.

6. The shoulder support of claim 1, wherein the inner wall of the main body is adapted to be removably mounted to the end of the gunstock with mounting screws that pass through holes in the main body to secure the shoulder support to the end of the gunstock.

7. The shoulder support of claim 1, wherein the first surface of the extension member is substantially coplanar with the opposed outer wall of the main body and curved to conform to the user's shoulder.

8. A shoulder support for mounting on an end of a gunstock of a firearm to be held on a user's shoulder, the adjustable shoulder support comprising:

a. an elongated main body that includes a chamber having an inner wall and an opposed outer wall, a top end and a bottom end, wherein the inner wall of the main body is adapted to be removably mounted to the end of the gunstock and the opposed outer wall of the main body is adapted to be placed on a user's shoulder;

b. an elongated extension member having a first surface and an opposed second surface, and a pivot end and an opposed free end, wherein the extension member is pivotally connected to the bottom end of the main body at the pivot end of the extension, the extension having a lock member located at the pivot end, wherein the extension member can be selectively pivoted from an extended position to a collapsed position, such that iii. when in the extended position the first surface of the extension member is substantially coplanar with the opposed outer wall of the main body and the lock member protrudes into the chamber at the bottom end of the main body; and iv. when in the collapsed position the first surface of the extension member is not substantially coplanar with the opposed outer wall of the main body and the free end abuts against the gunstock;

c. a lock release cap slidably mounted to the upper end of the elongated main body adapted to be grasped by the user, the lock release cap having a lower end and an upper end and a through hole connecting the upper end and lower end of the lock release cap;

d. a connecting rod having an upper end, a mid-section and a lower locking end, i. the upper end of the connecting rod slidably mounted within the through hole of the lock release cap and having a stop on the upper end of the connecting rod to enable the connecting rod to travel with the release cap when the release cap is raised by the user;

ii. the mid-section of the connecting rod slidable within the chamber of the main body and surrounded by a spring that urges the lower locking end of the connecting rod toward the bottom end of the main body;

iii. the lower locking end of the connecting rod slideably mates with the lock member of the extension member when the extension member is selectively positioned in the extended position to lock the extension member in the extended position;

wherein when the extension member is selectively pivoted to the extended position, the lock member contacts the lower locking end of the connecting rod to raise the upper end of the connecting rod above the upper end of the lock release cap and when in the extended position the spring urges the lower locking end of the connecting rod toward the bottom end of the main body forcing the lower locking end of the connecting rod to slidingly mate with the lock member of the extending member to lock the extending member in the extended position, and subsequently when the lock release cap is grasped by the user to raise the release cap the stop on the upper end of the connecting rod is raised with the lock release cap causing the lower locking end of the connecting rod to slidingly disengage from the lock member of the extending member to permit the extending member to pivot to the collapsed position, and when the extending member is in the collapsed position the spring urges the lower locking end of the connecting rod to abut the lock member of the extending member to maintain the extending member in the collapsed position.

9. The shoulder support of claim 8, wherein the inner wall of the main body is adapted to be removably mounted to the end of the gunstock with mounting screws that pass through holes in the main body to secure the shoulder support to the end of the gunstock.

10. The shoulder support of claim 8, wherein the main body is integral included in the end of the gunstock.

11. The shoulder support of claim 7, wherein the first surface of the extension member is substantially coplanar with the opposed outer wall of the main body and curved to conform to the user's shoulder.

* * * * *